US005803428A

United States Patent [19]

Marello

[11] Patent Number: 5,803,428

[45] Date of Patent: Sep. 8, 1998

[54] SANDING FIXTURE

[76] Inventor: Dino Marello, 556 Manorville Rd., Saugerties, N.Y. 12477

[21] Appl. No.: 630,490

[22] Filed: Apr. 10, 1996

[51] Int. Cl.[6] ..... F16M 9/00

[52] U.S. Cl. ..... 248/676; 248/674; 248/637; 248/127; 248/187

[58] Field of Search ..... 248/674, 637, 248/127, 176.1, 187, 676; 51/170, 135 R, 359; 403/381, 345, 17, DIG. 4

[56] References Cited

U.S. PATENT DOCUMENTS 1,828,043 10/1931 Hedgpeth ..... 51/170
1,883,138 10/1932 Walter ..... 248/674 X
2,630,151 3/1953 Turnbull ..... 51/170
3,215,378 11/1965 Kroll ..... 248/674
5,542,642 8/1996 Rivard ..... 248/676

*Primary Examiner*—Carl D. Friedman
*Assistant Examiner*—W. Glenn Edwards

[57] ABSTRACT

A Sanding Fixture for use with a portable electric belt sander to adapt such a hand-held sander into a table sander. Two parallel spaced plates are used with the top plate having a cut-out corner to allow the portable electric belt sander to be placed on the base plate with the sanding belt of the portable electric belt sander adjacent an edge of the top plate and extending above the top plate. Removable pegs are placed in selected openings in the base plate to permit use of sanders of varying manufacture and to hold the sander in place adjacent the top plate.

3 Claims, 3 Drawing Sheets

SANDING FIXTURE

BACKGROUND OF THE INVENTION

In wood working, it is essential for a shop to have a portable electric belt sander which is hand held. Such a portable electric belt sander, as is commonly known, has a continuous sanding belt which is pulled over a bottom surface by a drive cylinder powered by an electric motor. When the belt is placed against a piece of wood, the sanding belt finishes the wood surface.

It is also very desirable, if not essential, for any wood working shop also to have a table sander. A table sander provides a fixed table top which is horizontally aligned and a sanding belt vertically aligned and extending from the table top. This permits the feeding of a wood board along the table top while an edge of the board is sanded by the belt. Since the table top permits even feeding of the board, the sanding of the edge of the board of wood stock is consistent which would not be possible using a portable electric belt sander in such an application.

Table sanders are a comparatively expensive tool and to be able readily to adopt the portable electric belt sander for use as a table sander would provide not only a source of economy but would also reduce the need for shop space.

It is therefore a primary object of the present invention to provide a sanding fixture to use with a portable electric belt sander to create a table sander.

It is another object of this invention to provide a sanding fixture which is economical to construct.

It is another object of this invention to provide a sanding fixture which is easily stored.

SUMMARY OF THE INVENTION

The foregoing and additional objects are attained in accordance with the principles of this invention by providing a sanding fixture with a base plate and a top plate located parallel to and in paced relationship with one another. The top plate has a corner cut out thus covering a substantial portion of the base plate but leaving a portion of the base plate exposed. The portable electric belt sander is mounted on the exposed portion of the base plate and adjustable means are provided to secure portable electric sanders of varying manufacture in place.

DETAILED DESCRIPTION OF THE INVENTION

Figure 1:
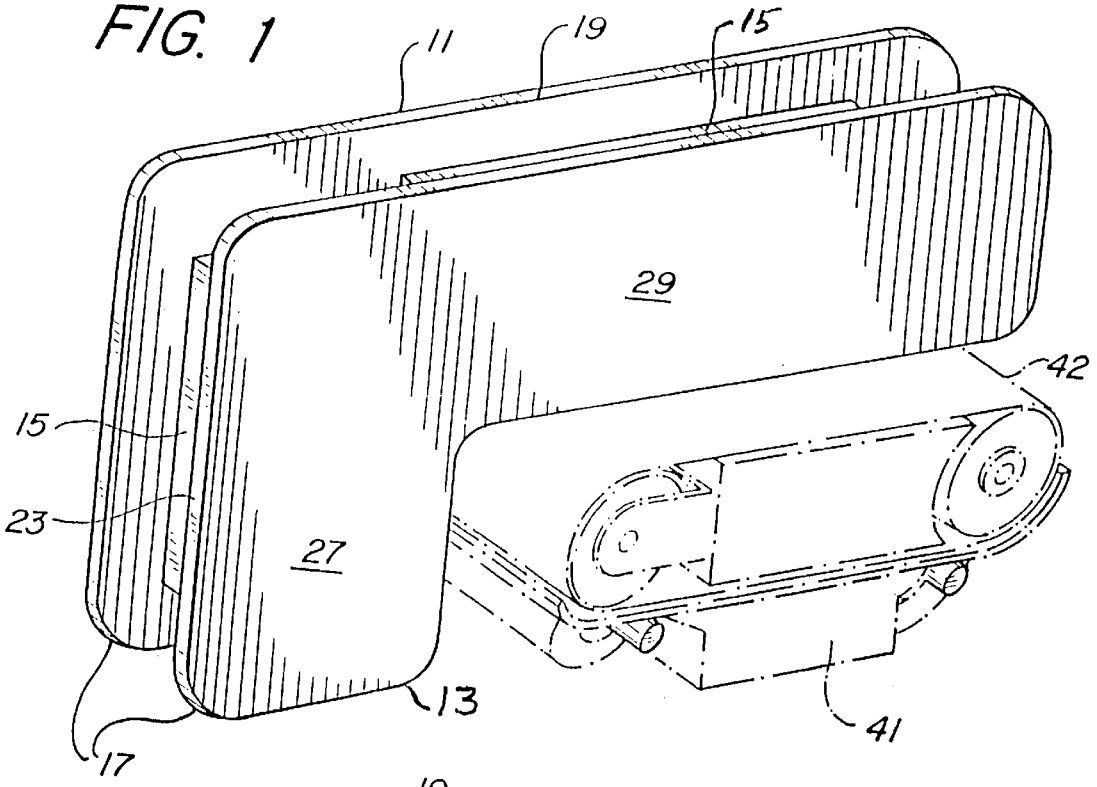
FIG. 1 is a pictorial view of the sanding fixture located on edge on a table with the table top vertically oriented showing the table top with the portable electric belt sander in place.
Figure 2:
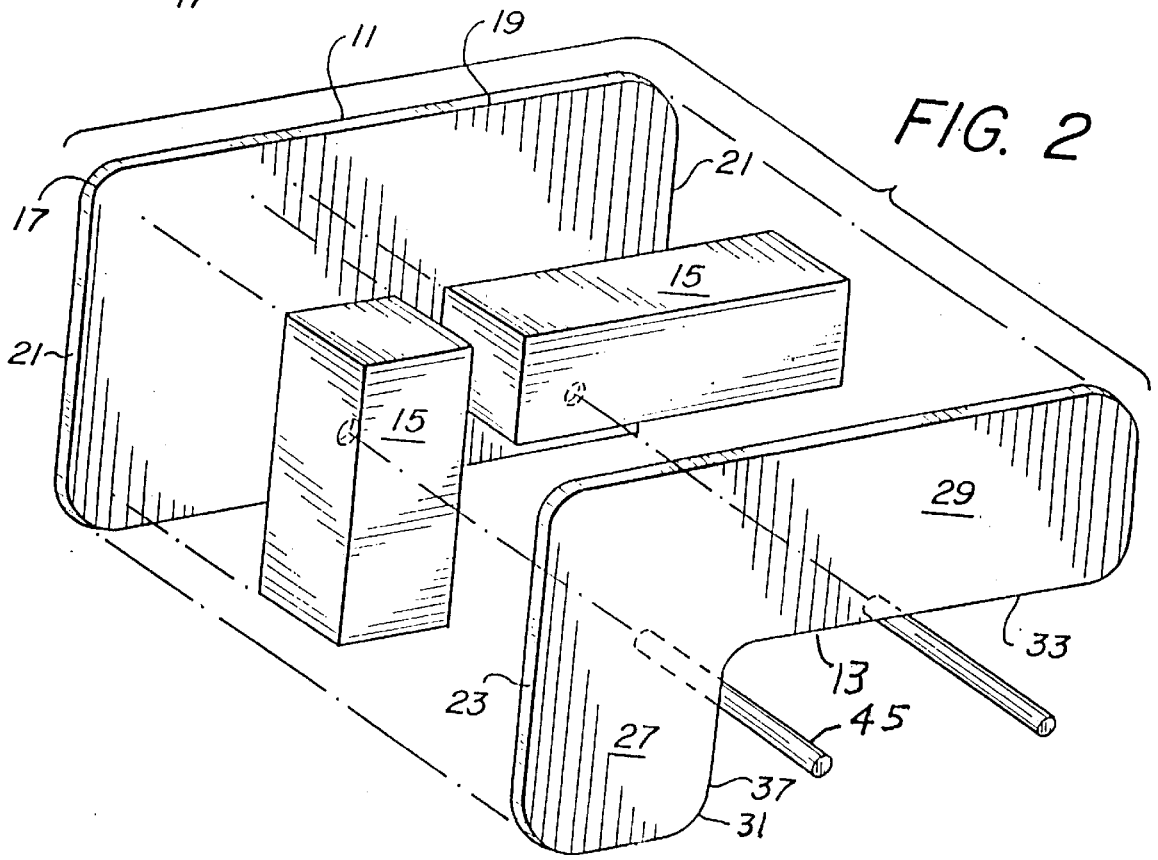
FIG. 2 is an exploded view of only the sanding fixture showing the base plate and the top plate with the blocks used to hold the two plates in a spaced relationship and also showing the pegs used to hold the portable electric belt sander in place.
Figure 3:
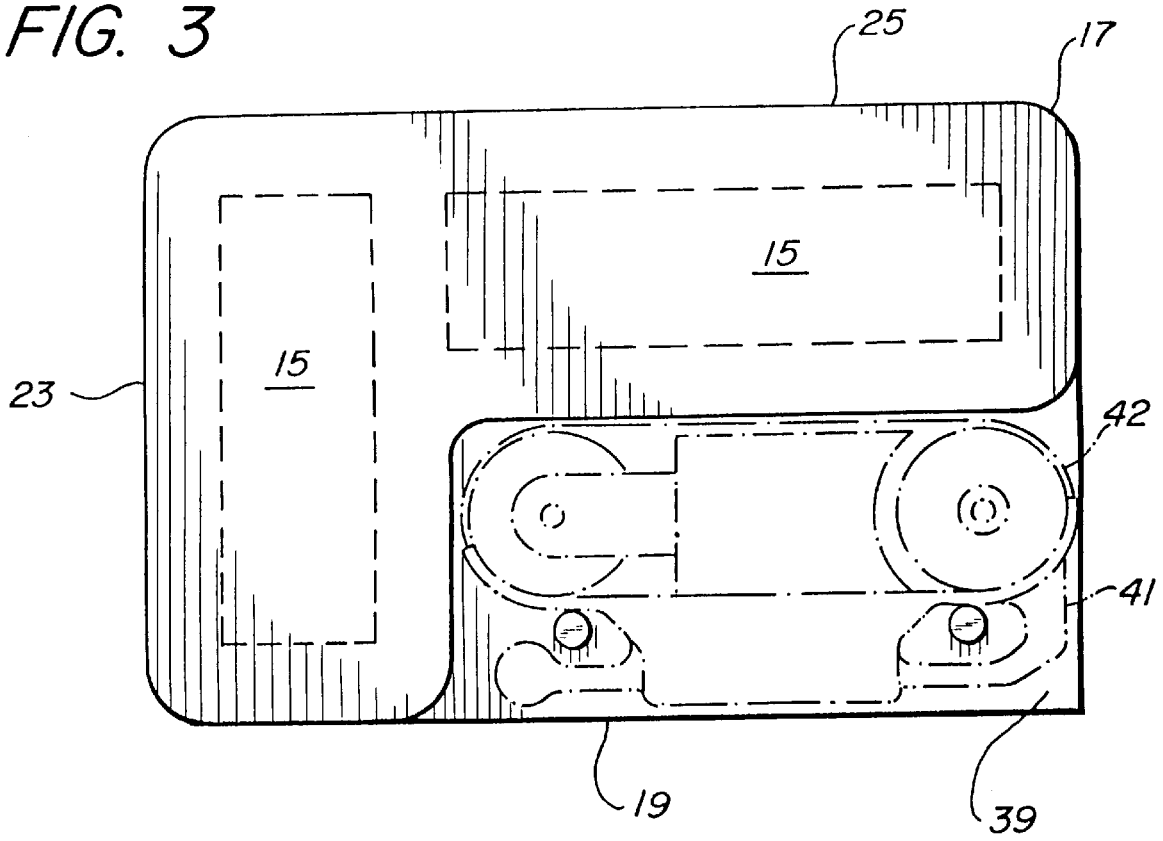
FIG. 3 is a top plan view of the sanding fixture with the portable electric sander in place and showing the location of the blocks between the top plate and the base plate.
Figure 4:
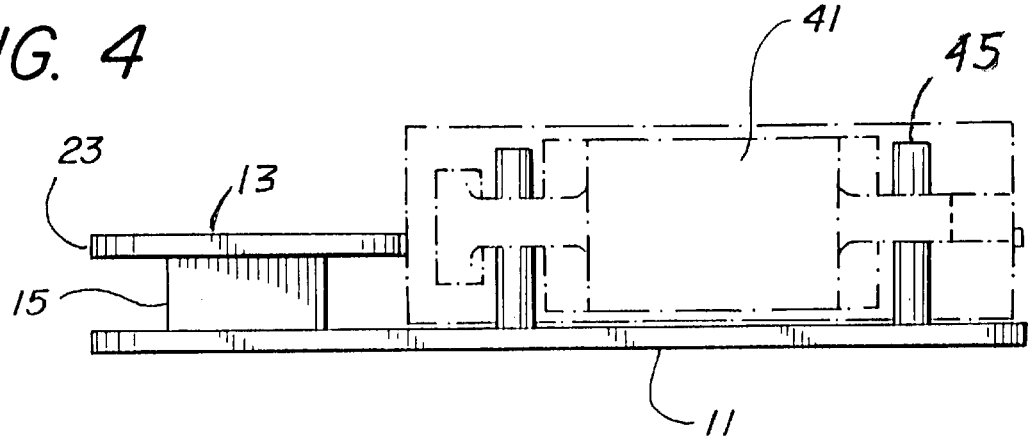
FIG. 4 is a side elevation along the major edge of the base plate showing the portable electric belt sander in place on the base plate and the partial major edge of the top plate with a block between the base plate and the top plate.
Figure 5:
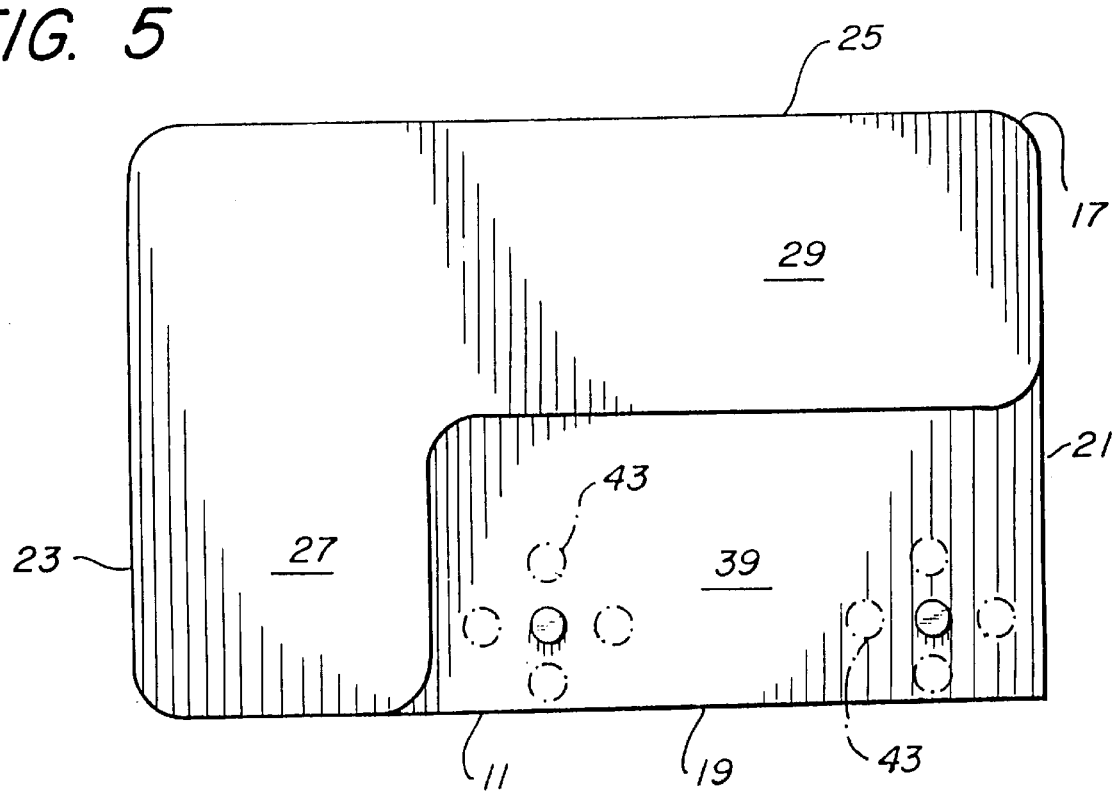
FIG. 5 is a top plan view of the sanding fixture showing the openings in the base plate in which posts are mounted to secure the portable electric belt sander to the sanding fixture.

Referring now to the drawings and particularly to FIGS. 1 and 2, the sanding fixture is shown including a base plate 11, a top plate 13 and a pair of blocks 15 used to secure the base plate 11 and the top plate 13 in a substantially parallel spaced relationship to one another. The base plate 11 is rectangularly shaped and preferably has rounded corners 17. The top plate 13 also has the same rounded corners 17.

The base plate 11, which has a generally rectangular configuration, has two major edges 19, which are parallel to one another, and two minor edges 21 also generally parallel to one another. The two minor edges 21 are located substantially at right angles to the two major edges 19. The major edges 19 of the base plate 11 are longer than the minor edges 21 of the base plate 11.

The top plate 13 is L-shaped and has a minor edge 23 and a major edge 25. As a result of the L-shape of the top plate 13, the top plate 13 has a minor leg 27 and a major leg 29. Parallel to the major edge 25, the top plate 13 has an outer major edge 31 and an inner major edge 33. Parallel to the minor edge 25, the top plate 13 has an outer minor edge 35 and an inner minor edge 37. The major edge 25 of the top plate 13 is longer than the minor edge 23 of the top plate 13.

The outer major edge 31 and the inner major edge 33 of the top plate 13, in combination, are substantially equal to the length of the major edge 25 of the top plate 13. Similarly, the length of the outer minor edge 35 and the length of the inner minor edge 37 of the top plate 13 in combination, substantially equal the length of the minor edge 23 of the top plate 13.

The major edge 25 of the top plate 13 and the major edges 19 of the base plate 11 are substantially the same length and the minor edges 21 of the base plate 11 are substantially the same length as the minor edge 23 of the top plate 13.

The top plate 13 and the base plate 11 are located in parallel spaced relationship to one another. The pair of blocks 15 are affixed between the base plate 11 and the top plate 13. Both of the blocks 15 have a longitudinal axis and the longitudinal of the two blocks 15 are aligned substantially at right angles to one another. The two blocks 15 are essentially placed to be beneath and aligned with the two legs 27,29 forming the L-shape of the top plate 13.

The L-shape of the top plate 13 leaves an open area or open portion 39 of the base plate 11 not covered by the top plate 13. The open area 39 has substantially the same area as the area defined by the inner major edge 33 and the inner minor edge 37 of the top plate 13.

Portable electric belt sanders 41 have varying configurations but generally follow a common design. A wide selection of openings 43 are formed in the base plate 11 in the open area 39. Preferably the openings 43 are round drilled holes. The portable electric belt sander 41 is placed on the open area 39 with the sanding belt 42 of the sander 41 aligned with, and closely adjacent to the inner major edge 33 of the top plate 13. Pegs 45 are selectively and interchangeably inserted into the openings 43 to secure the portable electric belt sander 41 in place and the openings 43 selected depend upon the design of the portable electric belt sander 41 to fit about the portable electric belt sander 41 and hold the portable electric belt sander 41 securely in place.

Figure 6:
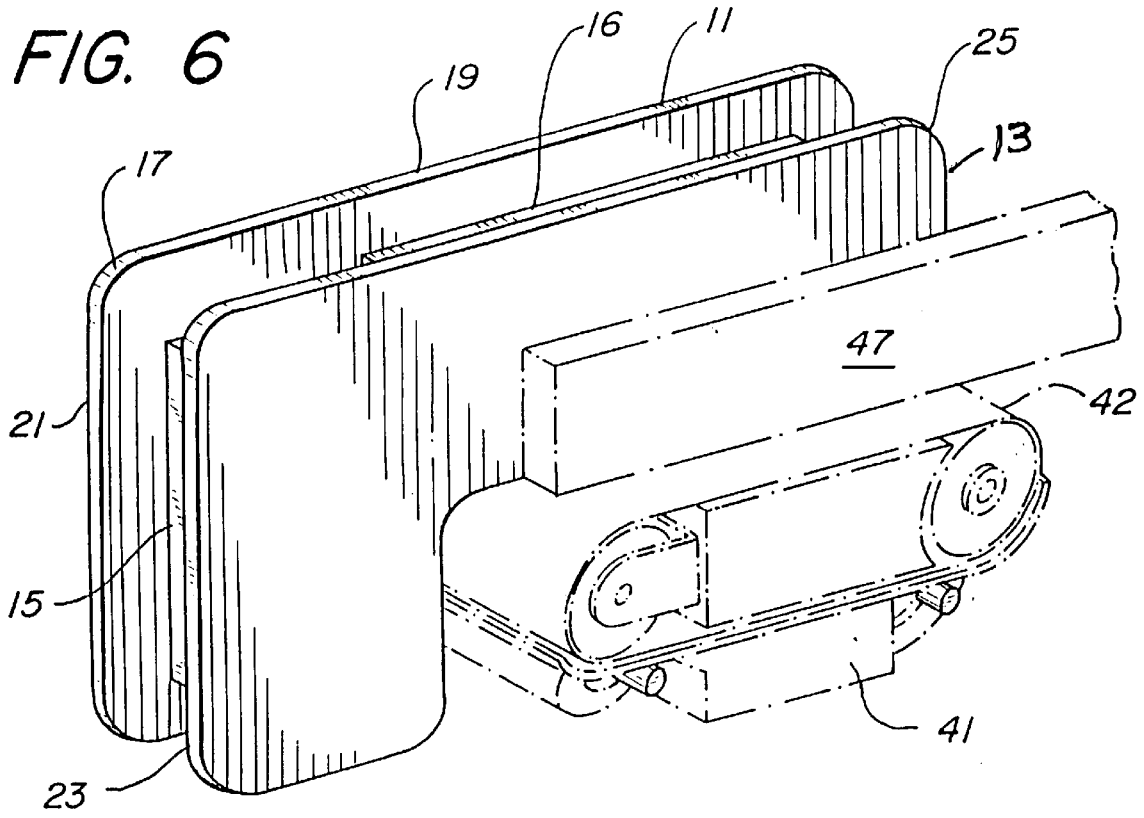
FIG. 6 is a pictorial view of the sanding fixture vertically oriented with the portable electric belt sander in place and showing a board being sanded by the sanding belt of the portable electric belt sander.

To use the sanding fixture, a piece of wood stock 47, as best seen in FIG. 6, is slid along the top plate 13 and against the activated sanding belt 42. In this way, the surface of the wood stock 47 is in contact with the sanding belt 42 of the portable electric belt sander 41 is sanded in the same manner as with a table sander.

Thus, while a preferred embodiment of the invention has been shown and described, it will be apparent to those skilled in the art that many other changes and modifications may be made without departing from the invention in its broader aspects. The appended claims are therefore intended to cover all such changes and modifications as fall within the true spirit and scope of the invention.

I claim:

1. A sanding fixture for use in combination with a portable electric belt sander mounted on the sanding fixture, such sanding fixture comprising:

a base plate;

a top plate having a L-shape, the base plate having a portion covered by the top plate and an open area, the open area having a multiplicity of openings in it, the base plate having a rectangular configuration with four edges and the top plate having two edges substantially the same length as two edges of the base plate;

means secured to both the top plate and the base plate to hold fixedly the top plate and the base plate in a spaced relationship; and a series of pegs for insertion into the openings in the base plate to hold the portable electric belt sander adjacent the top plate.

2. A sanding fixture for use in combination with a portable electric belt sander mounted on the sanding fixture, such sanding fixture comprising:

a base plate;

a top plate having a L-shape, the base plate having a portion covered by the top plate and an open area, the open area having a multiplicity of openings in it, the base plate having a rectangular configuration with four edges and the top plate having two edges substantially the same length as two edges of the base plate, the open area of the base plate being rectangular and the openings therein being round;

means secured to both the top plate and the base plate to hold fixedly the top plate and the base plate in a spaced relationship; and a series of pegs for insertion into the openings in the base plate to hold the portable electric belt sander adjacent the top plate.

3. A sanding fixture for use in combination with a portable electric belt sander mounted on the sanding fixture, such sanding fixture comprising:

a base plate having a generally rectangular configuration with rounded corners, said base plate having two pairs of generally parallel edges, one pair of generally parallel edges being major edges and the other pair of generally parallel edges being minor edges, the major edges being longer than the minor edges, the major edges and the minor edges being generally at right angles to one another;

a top plate having a generally L-shaped configuration with rounded corners, said top plate having a minor edge and an inner minor edge and an outer minor edge and one major edge and an inner major edge and an outer major edge, the major edge being longer than the minor edge, the top plate being located in a spaced relationship with the base plate and being generally parallel with the base plate, the minor edge of the top plate having substantially the same length and being aligned with one pair of minor edges of the base plate and the major edge of the top plate having substantially the same length and being aligned with one pair of major edges of the base plate, the inner minor edge and the inner major edge of the top plate defining an open area over the base plate, a multiplicity of openings being located in the base plate beneath the open area;

a pair of blocks located between and secured to both the base plate and the top plate, each of the blocks having a longitudinal axis, the longitudinal axis of the two blocks being generally at right angles to one another; and a series of pegs interchangeably mounted in the openings.

* * * * *